US008495885B2

(12) United States Patent
Cooper et al.

(10) Patent No.: US 8,495,885 B2
(45) Date of Patent: Jul. 30, 2013

(54) METHOD AND SYSTEM FOR LOCKING CONTROL SYSTEMS OF AN APPLIANCE AND AN APPLIANCE INCORPORATING THE SYSTEM

(75) Inventors: Anthony Cooper, Crestwood, KY (US); Josh Kopecky, Louisville, KY (US); Jerrod Kapler, Louisville, KY (US); Ranjan Damodar, Louisville, KY (US)

(73) Assignee: General Electric Company, Schenectady, NY (US)

( * ) Notice: Subject to any disclaimer, the term of this patent is extended or adjusted under 35 U.S.C. 154(b) by 641 days.

(21) Appl. No.: 11/962,070

(22) Filed: Dec. 20, 2007

(65) Prior Publication Data

US 2009/0158766 A1 Jun. 25, 2009

(51) Int. Cl.
*F25B 49/00* (2006.01)

(52) U.S. Cl.
USPC ..... 62/125; 62/126; 62/132; 236/94

(58) Field of Classification Search
USPC ..... 62/125, 126, 132; 236/94
See application file for complete search history.

(56) References Cited

U.S. PATENT DOCUMENTS

| | | | | |
|---|---|---|---|---|
| 5,889,684 | A * | 3/1999 | Ben-David et al. | 700/282 |
| 7,110,829 | B2 * | 9/2006 | Cunningham et al. | 700/2 |
| 2002/0003531 | A1 * | 1/2002 | Kim et al. | 345/173 |
| 2003/0056526 | A1 * | 3/2003 | Holmes et al. | 62/156 |
| 2005/0103875 | A1 * | 5/2005 | Ashworth et al. | 236/94 |
| 2007/0086151 | A1 * | 4/2007 | Oh et al. | 361/680 |
| 2008/0041073 | A1 * | 2/2008 | Ferragut et al. | 62/129 |
| 2008/0271475 | A1 * | 11/2008 | Wuesthoff et al. | 62/447 |

* cited by examiner

*Primary Examiner* — Cheryl J Tyler
*Assistant Examiner* — Jonathan Bradford
(74) *Attorney, Agent, or Firm* — Global Patent Operation

(57) ABSTRACT

A system for locking control systems of an appliance includes a lock control that is configured to selectively place at least one of the user-controllable systems in a locked condition while allowing another of the user-controlled systems to remain in an unlocked condition. The system generally includes an appliance operation control, at least one interface and the lock control. The appliance operation control is configured to control user-adjustable controllable systems of the appliance in response to input received by the appliance operation control. The at least one interface is on the appliance and is in communication with the appliance operation control. The at least one interface is configured to receive input via the interface to control at least two of the user-controllable systems of the appliance. When a user-controllable system is in the locked condition, the locked control system is inoperative or unable to be adjusted. A method for selectively locking control systems of an appliance is also disclosed.

13 Claims, 5 Drawing Sheets

METHOD AND SYSTEM FOR LOCKING CONTROL SYSTEMS OF AN APPLIANCE AND AN APPLIANCE INCORPORATING THE SYSTEM

BACKGROUND

Appliances, such as refrigerators and the like, having user-adjustable controls typically employ a locking system so that the controls can be locked and become inoperative. For example, refrigerators having water and ice dispensers typically include a button that can be depressed so that the dispenser is "locked" and thus inoperative. This prevents accidental dispensing of water and liquid.

Appliances, particularly refrigerators, now include displays and user-adjustable controls on the door of the refrigerator that allow the user to adjust the temperature compartments of the refrigerator. A locking system is known for locking the water dispenser to prevent the accidental dispenser of water and ice from the refrigerator; however, presently locking features are not available to prevent accidental adjustment of the temperature inside the compartments. Moreover, present locking systems do not allow for the locking of a temperature control system while still allowing the dispensing of water from the refrigerator or the locking of the water dispensing system while allowing for the adjustment of the temperature inside the compartments.

SUMMARY

A system for locking control systems of an appliance that overcomes the aforementioned shortcomings includes a lock control that is configured to selectively place at least one of the user-controllable systems in a locked condition while allowing another of the user-controlled systems to remain in an unlocked condition. The system generally includes an appliance operation control, at least one interface and the lock control. The appliance operation control is configured to control user-adjustable controllable systems of the appliance in response to received input. The interface is on the appliance and is in communication with the appliance operation control. Typically, the interface can be found on the door of the appliance and can be, for example, a reconfigurable display. The interface is configured to receive input via the interface to control at least two of the user-controllable systems of the appliance. When a user-controllable system is in the locked condition, the locked control system is inoperative or unable to be adjusted.

A method for selectively locking control systems of an appliance is also disclosed. The method generally includes displaying at least two lock control options; receiving an input based on the at least two lock control options; and in response to the input received, initiating a locked condition for at least one of the control systems of the appliance.

More particularly, a refrigerator is disclosed that employs a lock control. The refrigerator generally includes a reconfigurable display that is configured to receive input from a user, a water dispensing system, and a lock control. The lock control is associated with the display and the dispensing system. The lock control is configured to place the display and the water dispensing system in a locked condition.

DETAILED DESCRIPTION

Figure 1:
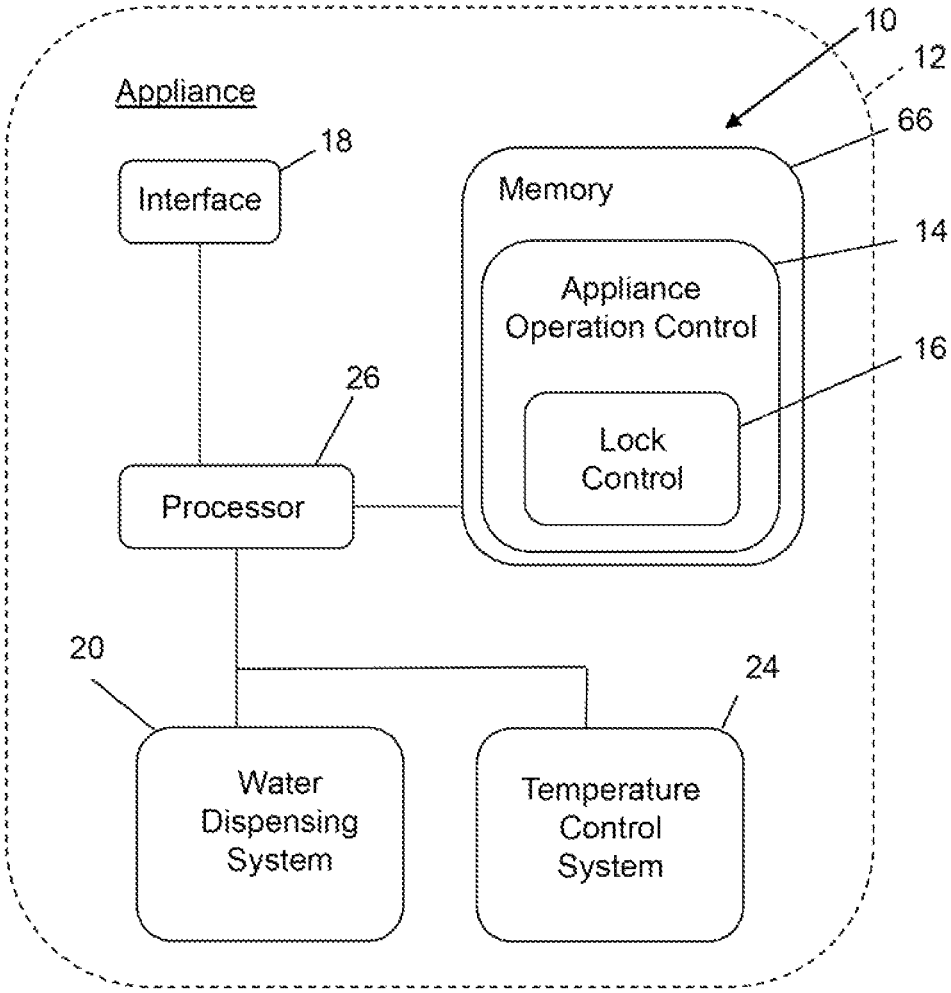
FIG. 1 is a schematic depiction of an appliance incorporating a system for locking user-adjustable control systems of the appliance.

With reference to FIG. 1, a lock control system 10 for locking controls for an appliance 12, such as a refrigerator (see FIG. 2), includes an appliance operation control 14, a lock control 16 and an interface 18. The system is useful to prevent the accidental operation of a system, for example the accidental dispensing of water from the refrigerator, or the accidental adjustment of another user-controllable system or control, for example the adjustment of the temperature inside one of the compartments of the refrigerator.

The lock control system 10 can be used with any appliance that includes user-adjustable control systems. For example, the system 10 can be used with a dishwasher, a range, an oven, a microwave oven, a washer, a dryer, and an air conditioner. The aforementioned list of appliances is non-limiting. The lock control system can be used with a refrigerator and will be described in detail for use with a refrigerator. This should not be taken to limit the system 10 to only being used with a refrigerator.

Generally, the appliance operation control 14 controls a plurality of operations that are performed by the appliance. In the example of a refrigerator, the appliance operation control controls, among other systems, user-controllable systems such as a user-controllable water dispensing system 20, and a user-controllable temperature control system 22. The appliance operation control can also control other systems or components of the refrigerator, e.g., the compressor, lights, ice makers, etc. Where the lock control system 10 is employed in another appliance, such as a microwave oven, the appliance operation control can control such user-controllable systems like the timer system and the power delivery system, which regulates the power of the cooking cycle for the microwave oven.

Figure 2:
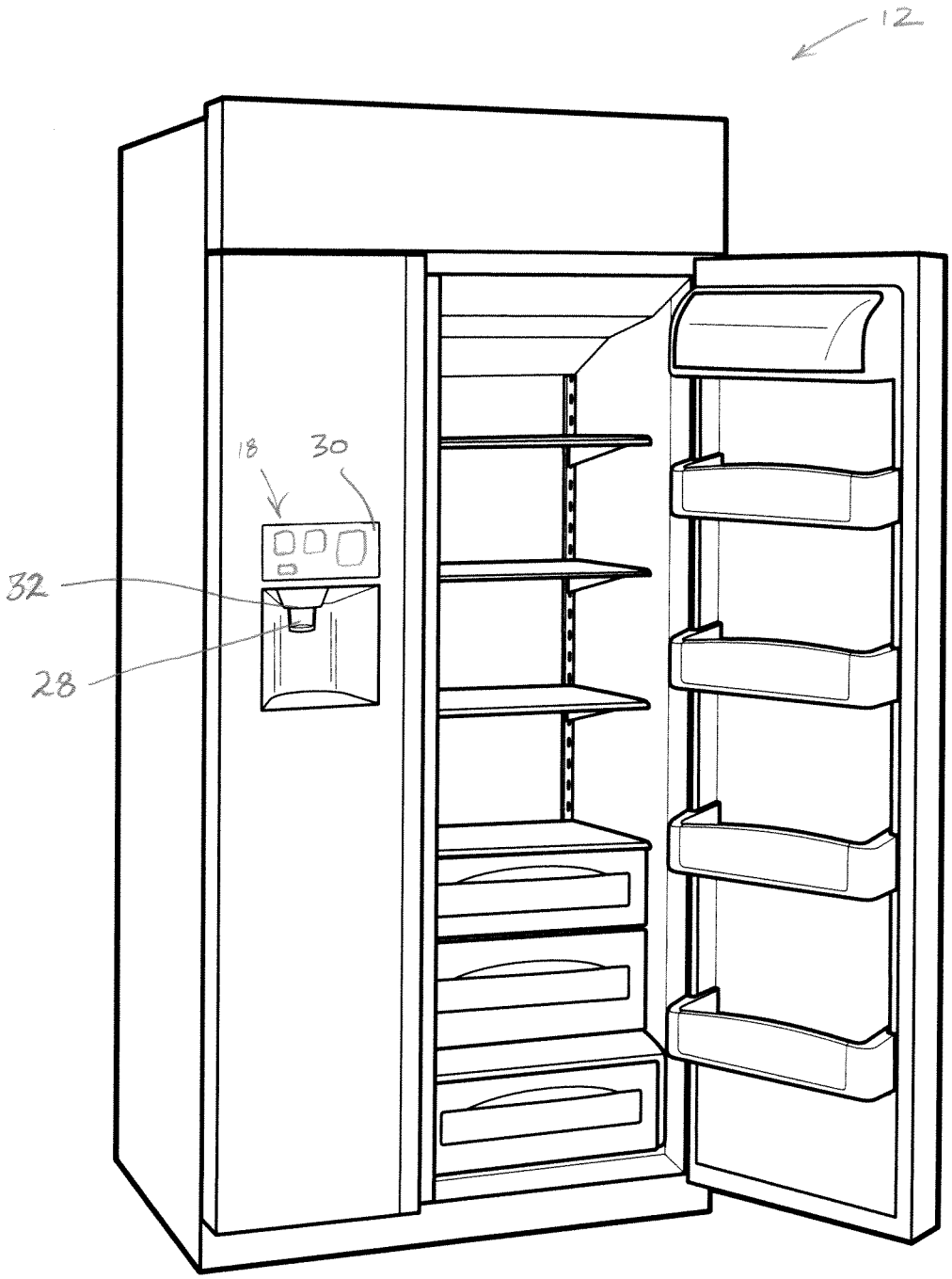
FIG. 2 is a perspective view of a refrigerator that can include the system that is schematically depicted in FIG. 1.
Figure 3:
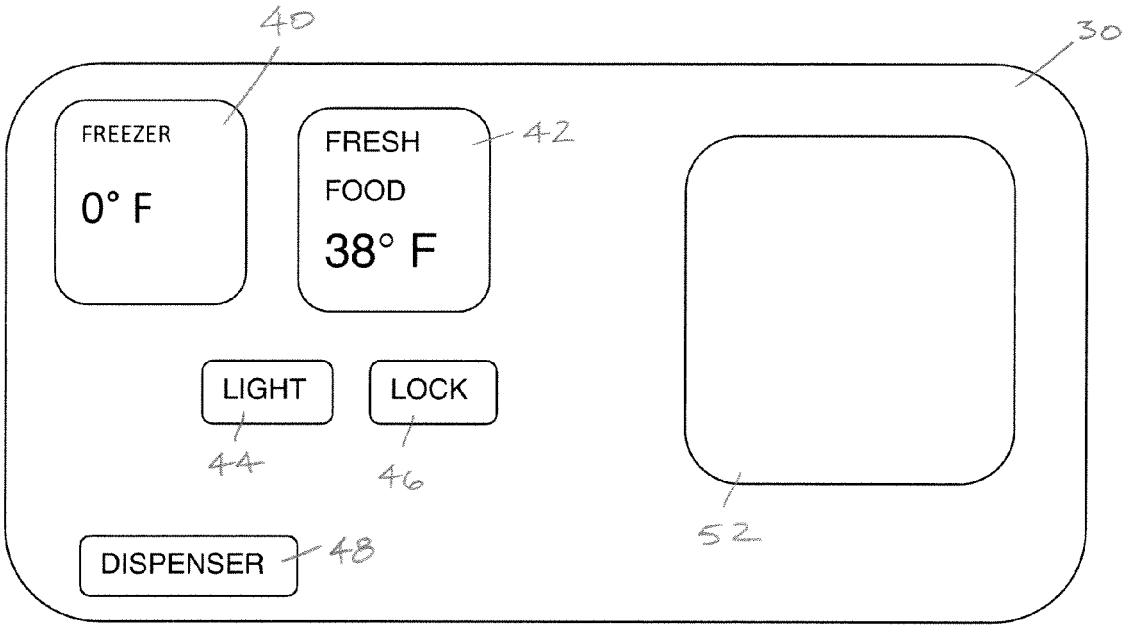
FIG. 3 is a view of a screen shot for a reconfigurable display for the refrigerator depicted in FIG. 2.
Figure 4:
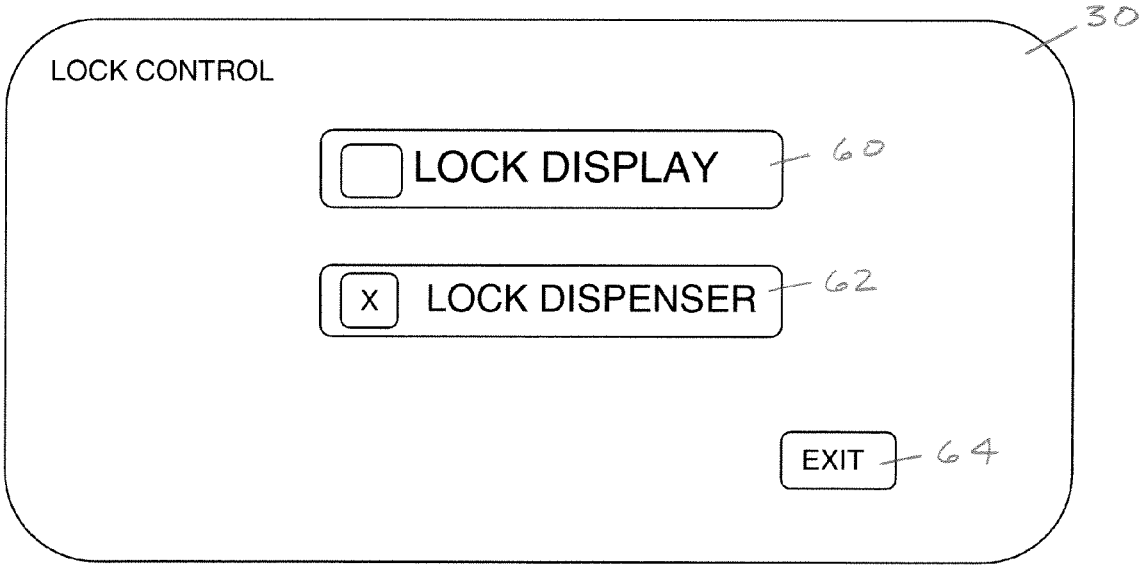
FIG. 4 is a view of another screen shot for the reconfigurable display after the "lock" button has been touched.

The appliance operation control 14 is also configured to control user-controllable systems of the appliance in response to input received by the appliance operation control 14. The input can be received via the interface 18, which will be described in more detail below. The interface 18 is coupled with the processor 26, which is coupled with the memory 66 and with the water dispensing system 20 and the temperature control system 22. As shown in FIGS. 2, 3 and 4, an embodiment of the interface 18 comprises a touch screen. The appliance operation control 14 and/or the lock control 16 can be included in a software program stored on a memory 66 in the appliance, e.g. refrigerator 12.

With reference back to the refrigerator 12 that incorporates the locking control system 10, as mentioned above the refrigerator can include a water dispensing system 20 that dispenses water or ice when a trigger 28 (FIG. 2) is depressed. The appliance operation control 14 regulates, for example, whether a valve (not visible) opens to dispense water from a dispenser when the trigger is depressed. The appliance operation control 14 also regulates whether ice or whether water is being dispensed from the water system. Other than that the water dispensing system used in the refrigerator can be placed into a locked condition and that it can operate when other systems of the appliance are in a locked condition, the water dispensing system is similar to one that is known to those who are skilled in the art, and therefore further explanation of the system is not provided.

The appliance operation control 14 also controls other systems of the refrigerator, e.g. the temperature control system 22 that controls the temperature inside the compartment (s) of the refrigerator and an illumination system that operates a light or lights to illuminate portions or compartments found in or on the refrigerator. Other than that the temperature control system 22 can be placed into a locked condition, controlling the temperature inside the compartment can be performed in a known manner by controlling the operation of the compressor (not shown) found in the refrigerator. Also, other than that the illumination system can be placed into a locked condition, controlling the light system can also be performed in accordance with a known manner. The appliance operation control 14 can also control other functions and systems of the refrigerator, for example controlling the display system 24 and what is depicted on a display 30 of the refrigerator. The display 30 will be described in more detail below.

The lock control 14 is associated with the appliance operation control 12. For example, both the lock control and the appliance operation control can comprise at least a portion of a software program that is running on the processor 26 in the refrigerator, or other appliance. The lock control 14 can also be a simple switch that prohibits a signal to be delivered to the user-controllable system when the user-controllable system has been placed into a locked condition. The lock control 14 is configured to selectively place at least one of the user-controllable systems in a locked condition while allowing another of the user-controllable systems to remain in an unlocked condition. For example, the water dispenser 32 can be locked, and thus inoperative, while the controls, or buttons, to adjust the temperature inside the refrigerator can remain unlocked, and thus able to be adjusted. The lock control also operates to lock one or more of the operations performed by the appliance while allowing other operations performed by the refrigerator to be initiated. The lock control 16 operates to place the aforementioned user-controllable systems into a locked condition so that the function or operation that is typically performed by the system is no longer capable of being performed or that the user-controllable system is incapable of being adjusted when in a locked condition.

As an example, with reference back to the refrigerator 12 that incorporates the locking control system 10, when the lock control 16 operates to place the water dispensing system 20 in a locked condition the trigger 28 of the water dispensing system becomes inoperative—no ice or water will be dispensed from the dispenser 32. When the lock control 16 operates to place the display system in the locked condition, display images that are displayed on the display 30 (described below) and that are associated with user-controllable systems are unable to be adjusted when the display system is in the locked condition. For appliances other than refrigerators, display images that are displayed on the display can also become inoperative so that the user-controllable systems can no longer be adjusted or initiated. For example, the timer may no longer be able to be set on a microwave over when the timer system has been locked.

The interface 18 can take the form of the display 30 and be located on the door of the appliance. More particularly, the interface can be a reconfigurable display that is configured to receive input from a user of the appliance. For example, with reference to FIG. 3 the reconfigurable display 30 can be placed in a mode where it displays a plurality of images, which can include images that act as a sort of button. The display 30 can be configured so that when a user contacts or presses one of the buttons, an input is received by the processor 26 and the appliance operation control 14. As seen in FIG. 3, the display can display a freezer button 40, a fresh food button 42, a light button 44, and a lock button 46. Other buttons can also be displayed. The display can also include other images such as a dispenser image 48 and a screen 52 that can show photographs or other images. The display 30 can be configured to receive user input. Moreover, additional buttons can be located remote from the display 30, for example underneath the trigger 28 (FIG. 2), which can also act as the interface.

With reference back to FIG. 3, the display 30 displays images that can be touched by the user so that the processor 26 receives input. For example, to lock systems of the refrigerator, the lock icon 46 can be touched which results in the reconfigurable display 30 changing its display the screen shot shown in FIG. 4. The reconfigurable display changes to display a lock display image 60, a lock dispenser image 62 and an exit image 64. These images can also be touched, similar to the buttons 40, 42, 44 and 46 described above, to receive input into the processor. For example, FIG. 4 has been shown where the lock dispenser image 62 has been touched and an indication such as an "X" is provided in a box to indicate that the dispenser for the refrigerator has been locked. With reference back to FIG. 1, a memory 66 is in communication with the processor 26, and thus the lock control 16, to store the respective locked or unlocked condition of each user-controllable system.

Where the dispenser has been locked, the trigger 28 (FIG. 2) is inoperative. Accordingly, if the trigger is depressed no water comes from the dispenser 32 until the water dispensing system 20 is placed back into an unlocked condition.

Figure 5:
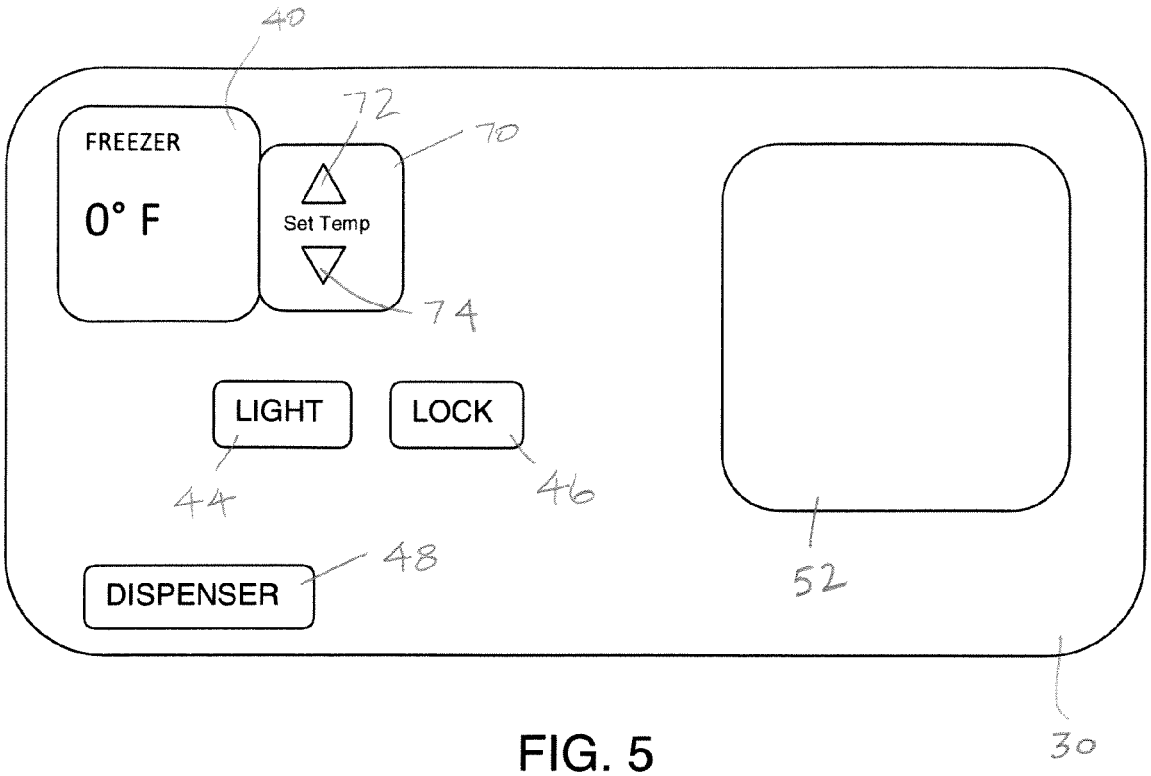
FIG. 5 is a view of another screen shot for the reconfigurable display after the "freezer" button has been touched when the reconfigurable display is in the unlocked condition.

FIG. 5 depicts the reconfigurable display 30 after a user has touched the freezer image 40 shown in FIG. 3 while the display is in an unlocked condition. The reconfigurable display 30 can display the freezer image 40 along with other images including a Set Temp image 70. The Set Temp image includes an upward pointing arrow 72 and a downward pointing arrow 74 and by touching the respective arrow, the temperature in the freezer compartment of the refrigerator can be changed. With reference back to FIG. 3, touching the fresh food image 42 results in a similar change in the reconfigurable display 30 as that shown in FIG. 5 with respect to the freezer image 40. With reference back to FIG. 4, the display can be locked by depressing the lock display image 60 on the reconfigurable display after the lock 46 has been depressed or touched.

As can be seen in FIG. 4, the reconfigurable display 30 provides an interface which allows for selectively placing at least one of the user-controllable systems in a locked condition while allowing another of the user-controllable system to remain in an unlocked condition. In other words, the reconfigurable display 28 can be locked and/or the dispenser system can be locked. Also, the lock control is configured to selectively place all or part of the display system in a locked condition. For example, the user can select to lock the temperature controls for the display while still allowing for the uploading of pictures.

The reconfigurable display 30 also displays information about the refrigerator. As seen in FIG. 3, the display 30 can display the temperature inside the freezer compartment and the temperature inside the fresh food compartment. The lock control system and the reconfigurable display can be configured so that the information that is displayed on the display updates, e.g. the respective temperatures inside the refrigerator, while the display remains in a locked condition. Moreover, the screen 52 can remain operational, e.g. still display images and/or photographs, while the display is in the locked condition. In sum, the reconfigurable display can be locked from only receiving input as an interface while still displaying information, e.g. temperature, time, photographs, etc.

Figure 6:
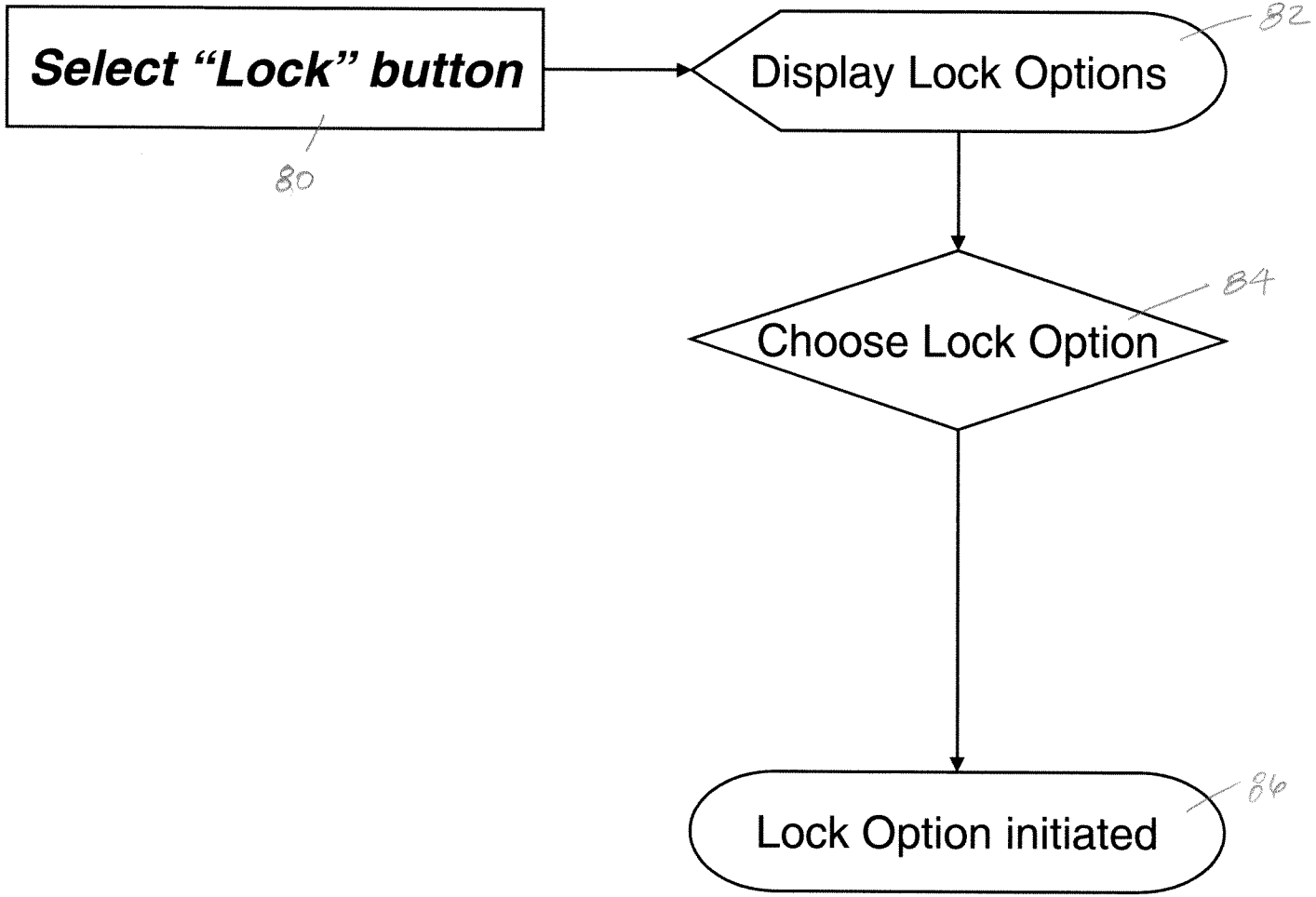
FIG. 6 is a flow diagram depicting a method for selectively locking control systems of an appliance.

With reference to FIG. 6, a method for selectively locking control systems of an appliance is shown. At step 80 the lock button 46 is selected by touching the lock image such as that shown in FIG. 3. After selecting the lock button, the lock options are displayed at step 82. This is shown in FIG. 4 which depicts the reconfigurable display having two lock options, those being lock display and lock dispenser. At step 84 a lock option is chosen. One or more partial locks may be selected. For example, the user could touch the lock display 60 and then choose to touch the exit image 64, which would result in only the reconfigurable display 30 being placed into a locked condition. The reconfigurable display can still update information when in the locked condition. Alternatively, the user can touch the lock dispenser image 62 and then touch the exit image 64, which would result in only the water dispensing system being locked. Alternatively, the user could lock each of the reconfigurable display and the water system by touching images 60 and 62 prior to touching the exit image 64. Moreover, the programming and reconfigurable display 30 can be configured to require a form of verification to accept a change from a locked condition to an unlocked condition, or vice versa. For example, after having touched the lock dispenser image and the exit image 64, the reconfigurable display 30 can be changed to display a verification query allowing the user the option to save the change in condition of the user-adjustable control system.

After the lock option has been chosen at step 84, the lock option is initiated at step 86. When a partial lock is initiated, for example, the reconfigurable display 30 is locked, but the water dispensing system is not locked, only the function of the reconfigurable display receiving input is unavailable. If a user attempts to select a function that is locked, a message, such as text or sound, can be provided to the user to indicate the function is not available.

The exemplary embodiment or embodiments have been described with reference to preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

What is claimed is:

1. A refrigerator, comprising:

an interface;

a processor coupled to the interface;

memory coupled to the processor; and a software program stored on the memory and configured to be executed by the processor to display a lock control and a button that controls operation of a first system as the interface and to display a verification query as the interface, wherein the button displays temperature corresponding to the inside of said refrigerator displayed thereon, wherein the lock control comprises a plurality of lock buttons that are configured to control operation of the interface and the button, respectively, and that lock and unlock the interface and the button independently of one another, wherein the temperature that is displayed on the button continues to update when the button is locked, wherein the verification query is required to lock and unlock the interface and the button, and wherein one of the lock buttons deactivates a trigger on a water dispensing system that is configured to cause dispensing of water or ice from the water dispensing system.

2. The refrigerator of claim 1, wherein the first system comprises a temperature control system.

3. The refrigerator of claim 1, wherein the memory is further configured to store a locked or unlocked condition of the first system.

4. A refrigerator, comprising:

a water dispensing system;

a touch screen forming an interface;

a processor coupled to the touch screen:

a memory coupled to the processor; and a software program stored on the memory and configured to be executed by the processor to provide a reconfigurable display to display a lock control and a button that controls operation of the water dispensing system as the interface on the touch screen and to display a verification query as the interface, wherein the touch screen displays temperature corresponding, to inside of said refrigerator, wherein the lock control comprises a plurality of lock buttons that are configured to control operation of the interface and the water dispensing system, respectively, and that lock and unlock the interface and the button independently of one another, wherein the temperature that is displayed on the button continues to update when the button is locked, and wherein the verification query is required to lock and unlock the interface and the button, wherein one of the lock buttons deactivates a trigger on the water dispensing system that is configured to cause dispensing of water or ice from the water dispensing system.

5. The refrigerator of claim 4, wherein the first lock button and the second lock button comprise images associated with the touch screen and the water dispensing system.

6. The refrigerator of claim 4, wherein the second lock button is inactive when the touch screen is locked.

7. The refrigerator of claim 4, wherein the memory is further configured to store a locked or unlocked condition of the touch screen and the water dispensing system.

8. The refrigerator of claim 4, further comprising, a temperature control system, wherein the reconfigurable display comprises a third lock button that is configured to lock and unlock the temperature control independently of the touch screen and the water dispensing system.

9. The refrigerator of claim 4, further comprising a fresh food system, wherein the reconfigurable display comprises a third lock button that is configured to lock and unlock the fresh food system independently of the touch screen and the water dispensing system.

10. The refrigerator of claim 4, wherein the reconfigurable display comprises a third lock button that is coupled to a light on the water dispensing system, and wherein the third lock button is configured to lock and unlock the light independently of the touch screen and the water dispensing system.

11. An appliance, comprising:

a first system;

a touch screen forming an interface; and a processor coupled to the touch screen;

memory coupled to the processor; and a software program stored on the memory and configured to be executed by the processor to provide a reconfigurable display to display a lock control and a button that controls operation of the first system as the interface on the touch screen and to display a verification query as the interface, wherein the button displaying temperature corresponding to the first system displayed thereon, wherein the lock control comprises a plurality of lock buttons comprising a first lock button and a second lock button that are configured to lock and unlock the interface and the button, respectively, and independently of one another, wherein the temperature that is displayed on the button continues to update when the button is locked, wherein the verification query is required to lock and unlock the interface and the button, wherein one of the lock buttons deactivates a trigger on a water dispensing system that is configured to cause dispensing of water or ice from the water dispensing system.

12. The appliance of claim 11, wherein the first system comprises a timer.

13. The appliance of claim 11, wherein the lock buttons comprise images displayed on the touch screen in response to execution of the software program by the processor.

* * * * *

UNITED STATES PATENT AND TRADEMARK OFFICE

CERTIFICATE OF CORRECTION

PATENT NO. : 8,495,885 B2
APPLICATION NO. : 11/962070
DATED : July 30, 2013
INVENTOR(S) : Cooper et al.

It is certified that error appears in the above-identified patent and that said Letters Patent is hereby corrected as shown below:

In the Specification

In Column 3, Line 25, delete "lock control 14" and insert -- lock control 16 --, therefor.

In Column 3, Line 26, delete "control 12." and insert -- control 14. --, therefor.

In Column 3, Line 29, delete "lock control 14" and insert -- lock control 16 --, therefor.

In Column 3, Line 32, delete "lock control 14" and insert -- lock control 16 --, therefor.

In Column 4, Line 57, delete "display 28" and insert -- display 30 --, therefor.

In the Claims

In Column 6, Line 17, in Claim 4, delete "screen:" and insert -- screen; --, therefor.

In Column 6, Lines 25-26, in Claim 4, delete "corresponding," and insert -- corresponding --, therefor.

In Column 6, line 48, in Claim 8, delete "comprising," and insert -- comprising --, therefor.

Signed and Sealed this
Twenty-second Day of October, 2013

Teresa Stanek Rea
*Deputy Director of the United States Patent and Trademark Office*